US008523336B2

(12) United States Patent
Kuribayashi

(10) Patent No.: US 8,523,336 B2
(45) Date of Patent: Sep. 3, 2013

(54) INK SUPPLY APPARATUS

(75) Inventor: Yasushi Kuribayashi, Shizuoka-ken (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/599,105

(22) Filed: Aug. 30, 2012

(65) Prior Publication Data

US 2013/0100213 A1 Apr. 25, 2013

(30) Foreign Application Priority Data

Oct. 19, 2011 (JP) ..... 2011-230048

(51) Int. Cl.
*B41J 2/175* (2006.01)
*B41J 2/18* (2006.01)

(52) U.S. Cl.
USPC ..... 347/85; 347/89

(58) Field of Classification Search
USPC ..... 347/84, 85, 86, 87, 89
See application file for complete search history.

(56) References Cited

U.S. PATENT DOCUMENTS

| | | | | |
|---|---|---|---|---|
| 6,443,560 | B1 * | 9/2002 | Okano et al. | 347/55 |
| 7,566,121 | B2 * | 7/2009 | Ohishi | 347/89 |
| 7,901,063 | B2 * | 3/2011 | Wouters et al. | 347/89 |
| 8,136,906 | B2 * | 3/2012 | Iwasaki | 347/17 |
| 8,197,046 | B2 * | 6/2012 | Asami | 347/89 |
| 8,403,467 | B2 * | 3/2013 | Asami | 347/85 |
| 2007/0291086 | A1 | 12/2007 | Murakami | |

* cited by examiner

*Primary Examiner* — Anh T. N. Vo
(74) *Attorney, Agent, or Firm* — Turocy & Watson, LLP

(57) ABSTRACT

According to one embodiment, an ink supply apparatus supplies ink to a recording head. The ink supply apparatus includes a pump for circulating ink, a first tank for supplying ink to the recording head, a second tank for receiving ink from the recording head, a third tank supplied with ink from an ink supply source, a first pressure adjusting mechanism, arranged between the first tank and the third tank, which is open if the pressure in the first tank is greater than a first given value to discharge ink in the first tank to the third tank, and a second pressure adjusting mechanism, arranged between the third tank and the second tank, which is open if the pressure in the third tank is lower than a second given value smaller than the first given value to draw ink in the third tank into the second tank.

11 Claims, 5 Drawing Sheets

INK SUPPLY APPARATUS

CROSS-REFERENCE TO RELATED APPLICATION

This application is based upon and claims the benefit of priority from the prior Japanese Patent Application No. 2011-230048, filed on Oct. 19, 2011, the entire contents all of which are incorporated herein by reference.

FIELD

Embodiment described herein relates generally to an ink supply apparatus which is applied to an image forming apparatus, such as, e.g., an ink jet printer.

BACKGROUND

An ink jet printer is equipped with a recording head for ejecting ink, and an ink supply apparatus for supplying ink to the recording head. In such a printer, a wiping, for example, is executed to clean the recording head which has an orifice plate on which a plurality of nozzles are formed. When the wiping is executed, ink is projected from the surface of the orifice plate through the nozzles to wet the surface of the orifice plate with ink.

In one of the examples of the conventional ink supply apparatus, a circulation flow path is composed of a first flow path which connects the inflow side of the recording head with the ink storage section and a second flow path which connects the outflow side of the recording head with the ink storage section. In addition, the first and second flow paths of the circulation flow path are connected with a bypass flow path, and a relief valve is provided in the bypass flow path. When the wiping is performed, a part of ink that flows from the first flow path toward the recording head flows to the second flow path through the bypass flow path. At this moment, the pressure of ink flowing from the ink storage section to the recording head is controlled by regulating the opening degree of the relief valve.

On the other hand, in case in which an image is formed with ink, it is desired to circulate ink between the recording head and the ink supply source. In the above-described ink supply apparatus, it is difficult to eject ink from the nozzle while ink is circulated when an image is formed. This is because that the pressure of ink in the recording head is maintained at a positive pressure when wiping is executed.

BRIEF DESCRIPTION OF THE DRAWINGS

Aspects of this disclosure will become apparent upon reading the following detailed description and upon reference to the accompanying drawings. The description and the associated drawings are provided to illustrate embodiments of the invention and not limited to the scope of the invention, wherein.

DETAILED DESCRIPTION

Figure 1:
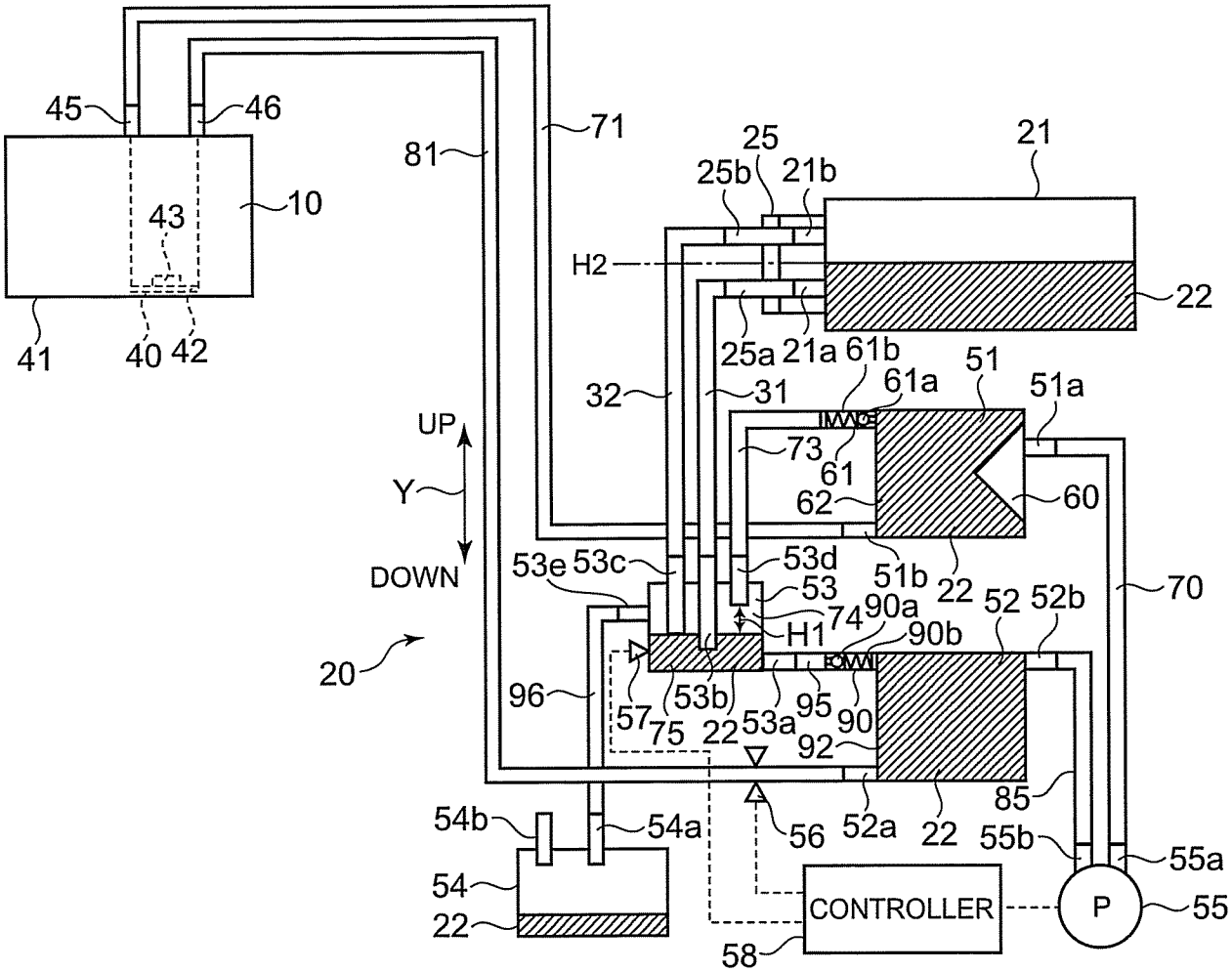
FIG. 1 is a schematic view illustrating a constitution of an ink supply apparatus according to one embodiment.

In general, according to one embodiment, it is to provide an ink supply apparatus which supplies ink to a recording head. The ink supply apparatus comprises a pump, a first tank having a first inflow port connected to the discharge port of the pump and a first outflow port connected to the ink supply opening of the recording head, a second tank including a second inflow port connected to the ink recovery opening of the recording head and a second outflow port connected to the intake port of the pump, a third tank, including an ink storage part open to air, which is supplied with ink from an ink supply source, a first relay pipe connected between the first tank and the third tank, a first pressure adjusting mechanism, arranged at the first relay pipe, that is configured to open if the pressure in the first tank is greater than a first given value to discharge ink in the first tank to the third tank, a second relay pipe which connects the ink storage part of the third tank and the second tank, and a second pressure adjusting mechanism, arranged at the second relay pipe, that is configured to open if the pressure in the third tank is lower than a second given value smaller than the first given value to draw ink in the third tank into the second tank.

Embodiment will now be described in more detail with reference to the accompanying drawings. However, the same numerals are applied to the similar elements in the drawings, and therefore, the detailed description thereof are not repeated.

(Embodiment)

According to one embodiment, in an ink supply apparatus which supplies ink to a recording head, an image can be formed by ejecting ink from the recording head while ink is circulated.

Hereafter, an ink supply apparatus according to the present embodiment will be described with reference to FIGS. 1□5.

FIG. 1 is a schematic view showing an ink supply apparatus 20 for supplying ink to the recording head (ink jet head) 10 of an ink jet printer as an example of an image forming apparatus. The ink supply apparatus includes one function in which ink is supplied from an ink cartridge 21 serving as an ink supply source to the recording head and another function in which ink is circulated.

The ink cartridge 21 is changeable and stores ink 22 in a sealed housing thereof. An ink supply port 21*a* and an air-open port 21*b* are provided in the housing of the ink cartridge 21. In FIG. 1, an up and down direction (height direction) is indicated by an arrow Y.

The ink supply apparatus 20 is provided with a connection section 25 connecting with the ink cartridge 21. The connection section 25 includes an ink-supply-connection port 25*a* which connects with the ink supply port 21*a* of the cartridge 21 and an air-open-connection port 25*b* which connects with the air-open port 21*b*. The ink-supply-connection port 25*a* is connected to an ink supply pipe 31 and the air-open-connection port 25*b* is connected with a through pipe 32. The ink supply pipe 31 and the through pipe 32 respectively extend from the connection section 25 in a lower direction.

The recording head 10 includes an orifice plate 41 on which a nozzle 40 that selectively ejects ink is formed, a pressure chamber 42 which is fluidly communicated with the nozzle 40, an actuator 43 which makes ink in the pressure chamber 42 eject through the nozzle 40, an ink supply port 45 and an ink recovery port 46 which are fluidly communicated with the pressure chamber 42, respectively. The pressure chamber 42 is deformed directly or indirectly by using a piezoelectric element such as a PZT as an actuator 43. Other examples of the recording head 10 are: one which drives a diaphragm with static electricity, one which heats ink by a heater to produce bubble and generates pressure by bubble produced, and further one which moves ink with static electricity, directly. Any one of the examples is usable. In a practical manner, the nozzle 40, the pressure chamber 42 and the actuator 43 of the above-described recording head 10 are provided in plural although each one thereof is illustrated in FIG. 1.

Further, the ink supply apparatus 20 includes a first tank 51, a second tank 52, a third tank 53, a waste ink tank 54, a circulation pump 55, an open/close valve 56, a liquid surface sensor 57 and a controller 58 all of which are arranged under the ink cartridge 21.

In the present embodiment, the ink cartridge 21 is arranged at a position higher than the first tank 51. The second tank 52 is arranged at a position lower than the first tank 51. The third tank 53 is arranged at a position in height between the first and second tanks 51 and 52. The waste ink tank 54 is arranged at a position lower than the third tank 53. A connection port 54*a* and an air-open port 54*b* are provided at an upper part of the waste ink tank 54. Relative positions in height of the recording head 10, the circulation pump 55 and the controller 58 may be set freely.

The circulation pump 55 is driven by a motor (not shown) and is controlled by the controller 58 as described later. The circulation pump 55 includes a discharge port 55*a* for discharging ink and an intake port 55*b* for drawing ink.

The first tank 51 is arranged at an upstream side to the recording head 10 in the ink supply direction. The interior of the first tank 51 is sealed to store ink 22. The first tank 51 is provided with a first inflow port 51*a*, a first outflow port 51*b*, a filter 60, a first relief valve 61 as an example of a first pressure adjusting mechanism and a first elastic member 62 as an example of a first pressure follow member.

The first inflow port 51*a* of the first tank 51 is connected to the discharge port 55*a* of the circulation pump 55 through the discharge pipe 70. Ink which is discharged from the discharge port 55*a* of the circulation pump 55 and flows toward the first tank 51 through the discharge pipe 70 passes the first inflow port 51*a* and the filter 60 and flows into the first tank 51. An example of the filter 60 is a fine mesh member attached to a frame.

The first outflow port 51*b* of the first tank 51 is arranged at a height the same as that of the bottom of the first tank 51. The first outflow port 51*b* is connected to the ink supply port 45 of the recording head 10 through a supply pipe 71. The reason why the outflow port 51*b* of the first tank 51 is provided at the bottom of the first tank Si is that it prevents air in the first tank 51 from being sent to the recording head 10 through the supply pipe 71.

The first relief valve 61 is provided at an uppermost part of the first tank 51. The first relief valve 61 is fluidly communicated with an air part 74 in the third tank 53 through a first relay pipe 73. Under the air part 74, an ink storage part 75 for storing ink exists. The reason why the first relief valve 61 is provided at the uppermost part of the first tank is that air in the first tank 51 is released completely.

An example of the first relief valve 61 is a one way valve comprising a valve body 61*a* and a spring 61*b*. When the pressure in the first tank 51 increases greater than a first given value, the valve body 61*a* is opened against the elastic force of the spring 61*b* and thus ink in which bubble may be mixed is supplied to the third tank 53 through the first relay pipe 73. That is, the first relief valve 61 functions as the first pressure adjusting mechanism which maintains the pressure in the first tank 51 at the first given value (positive pressure). Besides, instead of the valve body 61*a* and the spring 61*b*, combination of a pressure sensor and an electromagnetic valve may be employed. In this case, when the pressure in the first tank 51 reaches at the first given value, the electromagnetic valve is open to discharge ink.

Further, a first elastic member 62, an example of the first pressure follow member, is provided at the first tank 51. The first elastic member 62 is a diaphragm made of a material having elasticity such as a rubber, but other member may be used such as a balloon in which a gas, e.g., air, is sealed. Since the first elastic member 62 is in contact with ink 22 in the first tank 51, the first elastic member 62 is deformed elastically such that it is expanded toward the outside of the first tank 51 when the pressure of ink 22 in the first tank 51 increases. The first tank 51 is hard to be deformed because of its rigidity and thus the first elastic member 62 is elastically deformed in response to the pressure variation in the first tank 51. That is, the first elastic member 62 acts as a pressure storing means to maintain the inside of the first tank 51 at a positive pressure.

The second tank 52 is arranged at a downstream side to the recording head 10 in the ink discharging direction. The inside of the second tank 52 is also sealed as the same as the first tank 51. A second inflow port 52*a* is provided at the bottom of the second tank 52 such that the height of the second inflow port 52*a* is the same as that of the bottom of the second tank 52. The second inflow port 52*a* is connected to the ink recovery port 46 of the recording head 10 through a return pipe 81.

The open/close valve 56 is provided at the halfway of the return pipe 81. An example of the open/close valve 56 is a normally open valve which usually opens (at electricity being off) and closes when an instruction is output from the controller 58 (at electricity being on). Thus the open/close valve 56 is controlled by the controller 58 as described later.

A second outflow port 52*b* is provided at an upper part of the second tank 52. The second outflow port 52*b* is connected to the intake port 55*b* of the circulation pump 55 through a suction pipe 85. The second outflow port 52*b* is arranged at near the uppermost part of the second tank 52. The reason that the second outflow port 52*b* is arranged at the uppermost part of the second tank 52 is that air in the second tank 52 is completely sucked out to fill the second tank 52 with ink.

A second relief valve 90, an example of the second pressure adjusting mechanism, is provided at the second tank 52. The second relief valve 90 is arranged near the uppermost part of the second tank 52. The inflow side of the second relief valve 90 is fluidly communicated with the third tank 53 through the outflow side connection port 53*a* and the second relay pipe 95 which are arranged at the same height as the bottom of the third tank 53.

An example of the second relief valve 90 is a one way valve comprised of a valve body 90*a* and a spring 90*b*. When the pressure in the second tank 52 decreases smaller than a second given value, the valve body 90*a* is opened against the elastic force of the spring 90*b* and thus ink in the third tank 53 is drawn into the second tank 52. That is, the second relief valve 90 acts as the second pressure adjusting mechanism which maintains the pressure in the second tank 52 at the second given value smaller than the first given value. Besides, instead of the relief valve 90 comprising the valve body 90*a* and the spring 90*b*, a combination of a pressure sensor and an electromagnetic valve may be employed. In this case, when the pressure in the second tank 52 decreases below the second given value, the electromagnetic valve is open.

Further, a second elastic member 92, an example of the second pressure follow member, is provided at the second tank 51. The second elastic member 92 is a diaphragm made of a material having elasticity such as a rubber, but other member may be used. Since the second elastic member 92 is in contact with ink 22 in the second tank 51, the second elastic member 62 is deformed elastically in a concaved fashion toward the inside of the second tank 52 when the pressure in the second tank 52 decreases. The second tank 52 is hard to be deformed because of its rigidity and thus the second elastic member 92 is elastically deformed in response to the pressure variation in the second tank 52. That is, the second elastic member 92 acts as a negative pressure maintaining means to maintain the pressure in the second tank 51 lower than that in the first tank.

The third tank 53 includes the outflow side connection port 53*a* arranged at near the bottom of the thirst tank 53, a connection port 53*b* connected with the ink supply pipe 31, a connection port 53*c* connected with the through pipe 32, a connection port 53*d* connected with the first relay pipe 73 and an air through port 53*e* that is open at a position higher than the upper limit level of the liquid surface of ink 22 in the third tank 53. The liquid surface sensor 57 is arranged at the third tank 53 to detect the liquid surface of ink below a prescribed value that indicates empty of the third tank 53, substantially.

The outflow side connection port 53*a* of the third tank 53 is arranged at a position in height equal to that of the second relief valve 90. The outflow side connection port 53*a* is connected to the inflow side of the second relief valve 90 through the second relay pipe 95 which is arranged at a position in height equal to that of the second relief valve 90. In this way, an influence caused by the water head difference between the liquid surface of ink 22 in the third tank 54 and the second relief valve 90 can be minimized.

The connection port 53*b* connected to the ink supply pipe 31 is inserted into the third tank 53 from the upper side of the third tank 53. The lower end of the connection port 53*b* opens below the liquid surface of ink 22 in the third tank 53. The connection port 53*c* connected to the through pipe 32 is also inserted into the third tank 53 from the upper side of the third tank 53. The lower end of the connection port 53*c* opens at a position corresponding to a predetermined liquid surface level of ink 22 in the third tank 53.

The connection port 53*d* connected to the first relay pipe 73 is inserted into the third tank 53 from the upper side of the tank 53. The lower end of the connection port 53*d* opens at a position that is apart from the liquid surface of ink in the third tank 53 by a distance H1 (shown in FIG. 1) in the upper direction. Therefore, ink reaching to the connection port 53*d* from the first relief valve 61 through the first relay pipe 73 drops into the third tank 53 through air in the third tank 53.

The air through port 53*e* arranged near the upper part of the third tank 53 opens at a position higher than the upper limit level of the liquid surface of ink in the third tank 53. The air through port 53*e* is connected to the connection port 54*a* of the waste ink tank 54 through an air flow pipe 96. Thus, ink in the third tank 53 is discharged to the waste ink tank 54 through the air flow pipe 96 when the liquid surface of ink 22 in the third tank 53 increases higher than the air through port 53*e*.

Since the air open port 54*b* of the waste ink tank 54 always opens to air, the air part 74 in the third tank 53 is fluidly communicated with air through the air through port 53*e*, the air flow pipe 96, the waste ink tank 54 and the air open port 54*b*. In case in which ink is water-soluble, ink evaporated in the waste ink tank 54 enters into the air part 74 in the third tank 53 through the air flow pipe 96 and the air through port 53*e*. Thus, the inside of the third tank 53 is maintained at a given saturated vapor amount.

An operation of the ink supply apparatus 20 will be described below. Ink 22 in the ink cartridge 21 is supplied to the third tank 53 through the ink supply connection port 25*a* of the connecting section 25, the ink supply pipe 31 and the connection port 53*b*. When the liquid surface of ink 22 in the third tank 53 increases to reach at the lower end of the connection port 53*c*, the liquid surface of ink 22 in the third tank 53 does not increase thereafter. Instead of this, ink 22 flows from the connection port 53*c* to the through pipe 32 and then goes up in the through pipe 32. Ink in the through pipe 32 goes up to the same height H2 (shown in FIG. 1) as the liquid surface of ink in the ink cartridge 21.

On the other hand, when the liquid surface of ink 22 in the third tank 53 goes down, ink 22 in the ink cartridge 21 flows to the third tank 53 through the ink supply pipe 31 because of the connection port 53 being open to air. Or, ink staying in the through pipe 32 drops toward the third tank 53 and thus the liquid surface of ink 22 in the third tank 53 goes up to a height at which it covers the lower end (opening) of the connection port 53*c*. Therefore, the liquid surface of ink 22 in the third tank 53 is always maintained at the height of the lower end (opening) of the connection port 53*c*. This height is the predetermined liquid surface level.

In case in which the position of the second relief valve 90 is a height reference, the pressure occurred by the water head difference between the liquid surface of ink 22 in the third tank 53 and the ink in the second relief valve 90 influences the open pressure of the second relief valve 90, if the liquid surface level in the third tank 53 is set to excessively high. Thus, the liquid surface level in the third tank 53 is set to be a height at which air in the third tank 53 does not go toward the second relief valve 90. That is, the position of the lower end of the connection port 53*c* should be set to be higher than that of the outflow side connection port 53*a*.

If the ink cartridge 21 becomes empty, the liquid surface level of ink 22 in the third tank 53 decreases and the liquid surface sensor 57 is finally on. This is because that the liquid surface of ink in the third tank 53 can not maintain the predetermined liquid surface level. When the liquid surface sensor 57 is on, the controller 58 outputs a signal that informs a user or an upper level controller that the ink cartridge is empty.

Figure 2:
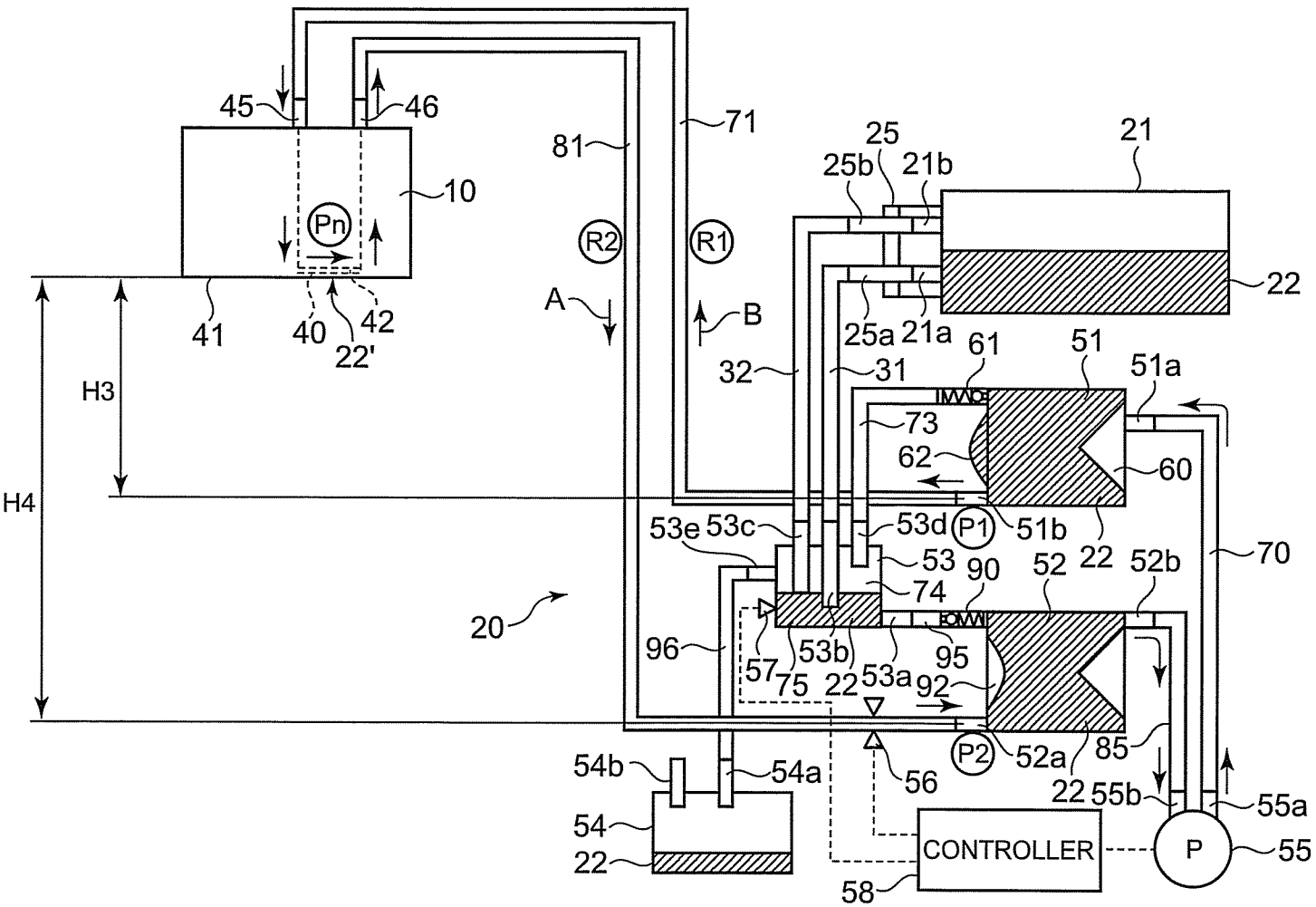
FIG. 2 is a view illustrating a state in which the ink supply apparatus shown in FIG. 1 is in an ink circulation mode.

FIG. 2 shows a state in which the ink supply apparatus 20 supplies ink to the recording head 10 as the apparatus 20 circulates ink (ink circulation mode). At the image forming operation, ink is consumed by ejecting ink 22' from the nozzle 40 of the recording head 10. In case in which ink is supplied while ink is circulated, an appropriate value in the ink pressure Pn near the nozzle 40 of the recording head exists. The pressure value Pn is a range between 0 (zero) Pa and −3000 Pa, for example.

To maintain the pressure Pn near the nozzle 40 at an appropriate pressure value, a first "energy par unit volume" P1 is managed by the first relief valve 61 and a second "energy par unit volume" P2 is also managed by the second relief valve 90 to satisfy the following formula (1):

$$P2=\{(R1+R2)/R1\}\times Pn-(R2/R1)\times P1 \quad (1)$$

Wherein:

- P1 (Pa): the energy per unit volume near the outflow port 51*b* of the first tank 51,
- R1 (Pa·sec/m$^3$): the flow pass resistance of the supply pipe 71 from the outflow port 51*b* to the nozzle 40 of the recording head 10,
- P2 (Pa): the energy per unit volume near the inflow port 52*a* of the second tank 52, and
- R2 (Pa·sec/m$^3$): the flow pass resistance of the return pipe 81 from the inflow port 52*a* to the nozzle 40 of the recording head 10.

The energy per unit volumes P1 and P2 are derived from Bernoulli's principle, and are the total of a static pressure, a dynamic pressure and a potential pressure. If the dynamic pressure can be ignored, the energy per unit volumes P1 and P2 are expressed as following formulas (2) and (3):

$$P1=Ps1-\rho\cdot g\cdot H3 \quad (2)$$

$$P2=Ps2-\rho\cdot g\cdot H4 \quad (3)$$

Wherein:

Ps1 (Pa): the static pressure near the outflow port 51*b* of the first tank 51, Ps2 (Pa): the static pressure near the inflow port 52*a* of the second tank 52, H3 (m): the distance from the orifice plate 41 to the outflow port 51*b* of the first tank 51, H4 (m): the distance from the orifice plate 41 to the inflow port 52*a* of the second tank 52, ρ(kg/m$^2$): the density of ink 22, and g (m/s$^2$): the acceleration of gravity.

In the present embodiment, as stated below, the management of the static pressures Ps1 and Ps2 of the above formulas (2) and (3) are realized with the first relief valve 61, the second relief valve 90, the first elastic member 62 and the second elastic member 92. The item of the potential pressure is determined by H3 and H4, exclusively. Therefore, the energy per unit volumes P1 and P2 can also be managed.

If the instruction of commencement of an ink circulation is input from a user or an upper level controller, the controller 58 drives the circulation pump 55. When the circulation pump 55 is driven, ink 22 in the second tank 52 is drawn into the circulation pump 55 from the intake port 55*b* and then the ink is discharged from the discharge port 55*a* of the circulation pump 55 toward the first tank 51.

At this moment, the first elastic member 62 is elastically deformed with the pressure of ink supplied to the first tank 51 and the pressure in the first tank 51 increases. When the internal pressure of the first tank 51 increases above the first given value, the first relief valve 61 opens and ink 22 in the first tank 51 is supplied to the third tank 53 through the first relief valve 61. The first given value of the internal pressure of the first tank 51 is a value at which the pressure near the outflow port 51*b* of the first tank 51 becomes the pressure Ps1.

If the first relief valve 61 opens, the inside of the first tank 51 opens to air for a moment. However, at this moment, the first elastic member 62 generates an elastic force which causes the elastic member 62 to return to the original state and thus the pressure in the first tank 51 is maintained at the first given value. Therefore, if the first relief valve 61 is closed while the first elastic member 62 generates the elastically restitutive force, the pressure in the first tank 51 can be maintained at the first given value. When the first relief valve 61 opens, ink 22 in the first tank 51 flows into the third tank 53 through the first relief valve 61 and the first relay pipe 73.

On the other hand, since ink 22 in the second tank 52 is drawn out by the circulation pump 55, the pressure in the second tank 52 decreases. Therefore, the second elastic member 92 is elastically deformed to the inside of the second tank 52 and thus the pressure in the second tank 52 decreases. If the pressure in the second tank 52 decreases below the second given value, the second relief valve 90 opens and ink 22 in the third tank 53 is drawn into the second tank 52 through the second relay pipe 95. That is, ink 22 in the ink storage part 75 flows into the second tank 52 through the second relay pipe 95 and the second relief valve 90. It should be noted that the second given value of the internal pressure of the second tank 52 is a value at which the pressure near the inflow port 51*a* of the second tank 51 becomes the pressure Ps2.

If the second relief valve 90 opens, the inside of the second tank 52 opens to air for a moment. However, at this moment, the second elastic member 92 generates an elastic force which causes the elastic member 92 to return to the original state and thus the pressure in the second tank 52 is maintained at the second given value. Therefore, if the second relief valve 90 is closed while the second elastic member 92 generates the elastically restitutive force, the pressure in the second tank 52 can be maintained at the second given value.

Assuming that the first relief valve 61 and the second relief valve 90 are directly connected with each other through a pipe, ink and air in the first tank 51 go directly toward the second relief valve 90 through the first relief valve 61 and thus air returns to the second tank 52. Moreover, the pressure that causes the first relief valve 61 to open acts on the second relief valve 90. There is a possibility that each relief valve 61, 90 does not open at each given pressure by the mutual action between the first relief valve 61 and the second relief valve 90.

However, in the present embodiment, the outflow side of the first relief valve 61 is fluidly communicated with the air part 74 in the third tank 53 through the first relay pipe 73 and the inflow side of the second relief valve 90 is fluidly communicated with the ink storage part 75 in the third tank 53 through the second relay pipe 95. Moreover, the liquid surface level of ink 22 in the third tank 53 is maintained constant according to the position of the lower end opening of the connection port 53*b*. Therefore, ink flowing into the third tank 53 from the first tank 51 through the first relief valve 61 and the first relay pipe 73 drops into the air part 74 from the lower end opening of the connection port 53*d* and further drops into the ink storage part 75 in the third tank 53 through the air part 74.

As forming the construction described above, even if air is mixed in ink in the first tank 51, ink and air are finally separated in the third tank 53 while ink including air in the first tank 51 is supplied to the third tank 53 from the first relief valve 61 through the first relay pipe 73. Therefore, only ink 22 in the third tank 53 returns to the second tank 52 through the second relay pipe 95 and the second relief valve 90 which is opened. It can prevent air from returning to the second tank 52.

When the ink cartridge 21 is empty, the liquid surface of ink 22 in the third tank 53 is lowered. If the liquid surface of ink 22 in the third tank 53 reaches at the position of the outflow side connection port 53*a*, air in the third tank 53 is fed to the second tank 52 through the second relief valve 90. However, since the liquid surface sensor 57 is arranged at a position higher than the outflow side connection port 53*a*, the liquid surface sensor 57 operates before air in the third tank 53 goes toward the second relief valve 90. Therefore, the controller 58 can inform a user or an upper level controller that the ink cartridge 21 is empty.

Arrows A and B in FIG. 2 respectively indicate directions in which ink circulates in the ink supply apparatus 20. As shown in FIG. 2, ink circulates the supply pipe 71 and the return pipe 81. And, at the image forming operation, ink 22' is ejected from the nozzle 40 of the recording head 10. In this circulation, since the pressure Pn near the nozzle 40 is set to satisfy the above-described formula (1), bubble is discharged to the second tank 52 through the ink recovery port 46 of the recording head 10 and the return pipe 81 even if the bubble is produced near the nozzle 40. The bubble discharged to the second tank 52 stays at the upper part of the second tank 52 as air, and is drawn out with the intake port 55*b* of the circulation pump 55 through the suction pipe 85 together with ink from the outflow port 52*b* of the second tank 52 when amount of the air exceeds a constant value. The air drawn out with the intake port 55*b* is discharged toward the inflow port 51*a* of the first tank 51 together with the ink through the discharge pipe 70 from the discharge port 55*a* of the circulation pump 55.

Ink including bubble supplied to the inflow port 51*a* of the first tank 51 enters into the first tank 51 through the filter 60 and the bubble in the ink stays at the upper part of the first tank 51 as air. When amount of the air exceeds a constant value, the air is discharged to the third tank 53 through the first relief valve 61 and the first relay pipe 73.

The ink supply apparatus 20 of the present embodiment properly maintains the pressure Ps1 near the outflow port 51*b* of the first tank 51 and the pressure Ps2 near the inflow port 52*a* of the second tank 52 by the first relief valve 61 acting as the first pressure adjusting mechanism and the second relief valve 90 acting as the second pressure adjusting mechanism. Thus, the pressure Pn near the nozzle 40 is also maintained properly. Therefore, the ink supply apparatus 20 removes bubble that may be mingled with ink during the image forming operation by circulating ink under a proper pressure and can charge ink in the circulation path. Since ink is supplied to the recording head 10 while ink is circulated, a foreign matter that is developed near the nozzle 40 of the recording head 10 returns to the second tank 52 through the ink recovery port 46 of the recording head 10, the return pipe 81 and the inflow port 52*a* of the second tank 52.

If the specific gravity of the foreign matter that is mingled with ink is greater than that of ink, the foreign matter is deposited at the bottom of the second tank 52 and thus it can prevent the foreign matter from moving in the circulation path together with ink. If the specific gravity of the foreign matter is smaller than that of ink, the foreign matter goes to the upper part of the second tank 52 and is drawn out from the intake port 55*b* of the circulation pump 55 through the outflow port 52*b* arranged at the upper part of the second tank 52 and the suction pipe 85 together with ink. The foreign matter is discharged to the first tank 51 together with ink from the discharge port 55*a* of the circulation pump 55 through the discharge pipe 70 and is collected with the filter 60.

Figure 3:
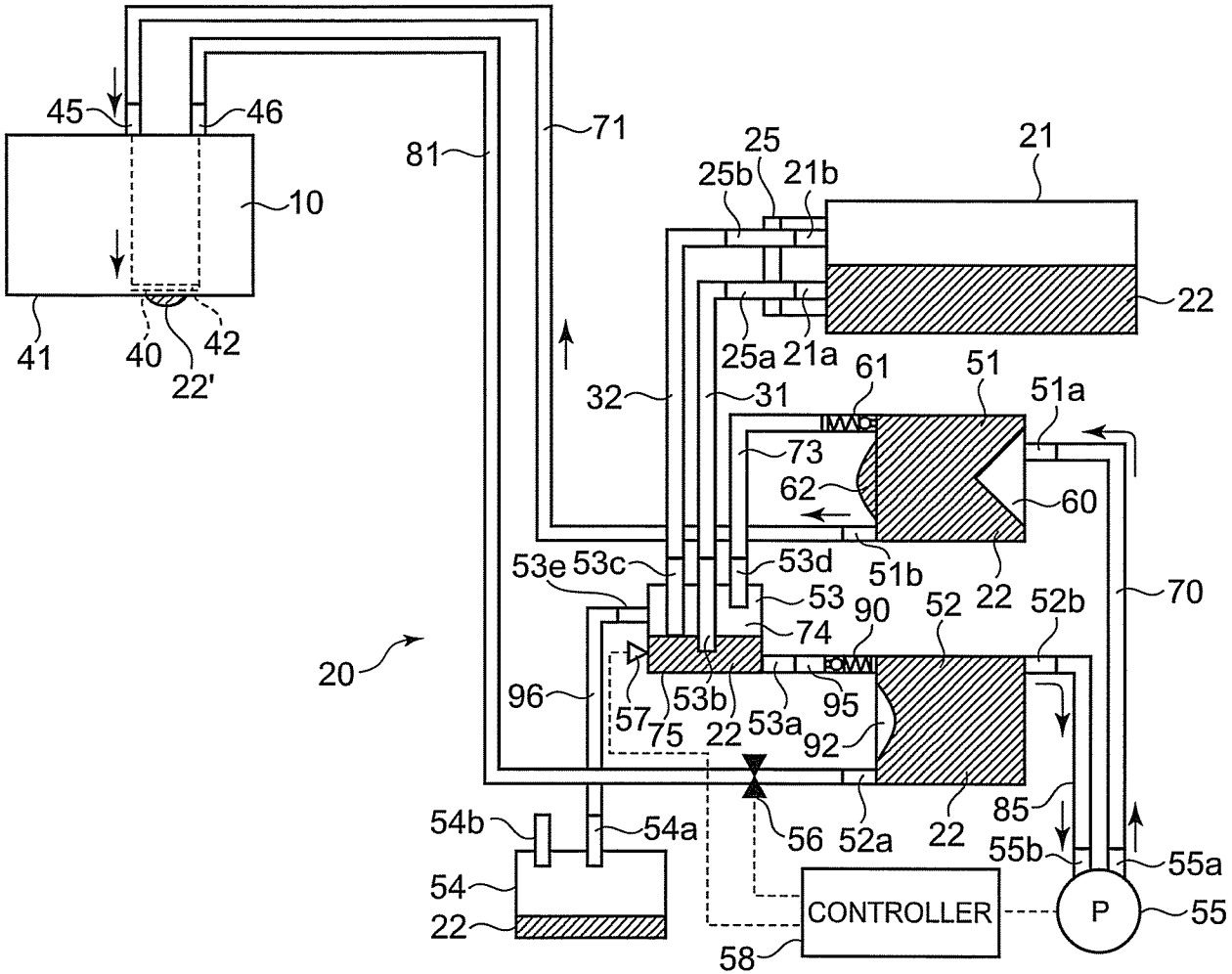
FIG. 3 is a view illustrating a state in which the ink supply apparatus shown in FIG. 1 is in an ink projection mode.

FIG. 3 illustrates an ink circulation pass along which ink is projected to wipe the orifice plate 41 of the recording head 10 (ink projection mode) in the ink supply apparatus. If an instruction that ink is projected is issued from a user or an upper level controller while the ink circulation is carried out, the controller 58 closes the open/close valve 56. After a given time T1 passes, the controller 58 opens the open/close valve 56. In this way, the pressure of ink from the first tank 51 is transmitted to the recording head 10 while the open/close valve 56 is closed. Thus, a positive pressure is applied near the nozzle 40 and ink 22' projects from the surface of the orifice plate 41. The given time T1 can be adjusted with a time at which the open/close valve 56 is closed.

Figure 4:
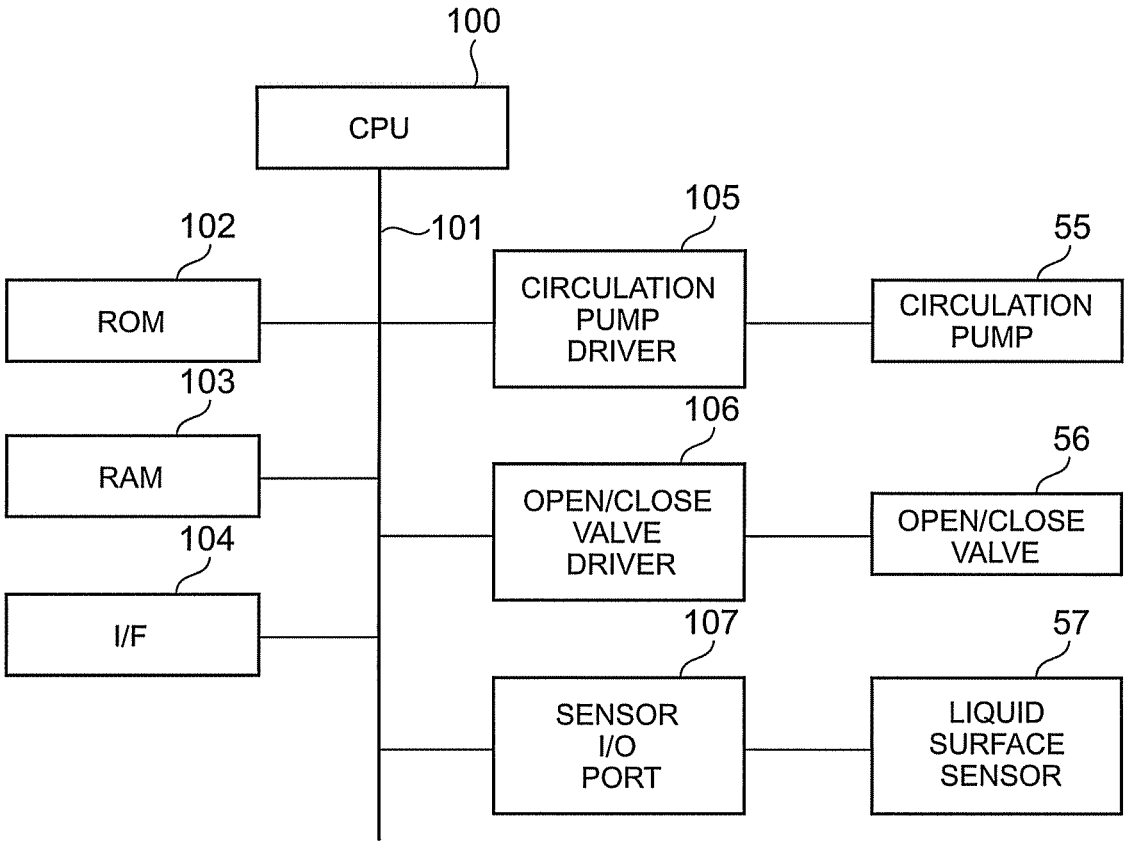
FIG. 4 is a block diagram illustrating a constitution of the controller of the ink supply apparatus.

FIG. 4 is a block diagram illustrating components of the controller 58 of the ink supply apparatus 20 according to the present embodiment. The controller 58 includes a CPU (Central Processing Unit) 100 acting as a processor. The CPU 100 is connected with a ROM (Read Only Memory) 102, a RAM (Random Access Memory) 103, a communication interface section 104, a circulation pump driver 105, an open/close valve driver 106 and a sensor input/output port 107 with a has line.

The ROM 102 stores programs for controlling the CPU 100 and various basic data. The RAM has a memory area to store various data which is required to eject ink and to circulate ink, for example, and provides work area in which data is temporarily stored. The communication interface section 104 controls a data communication with external devices through a communication line. The circulation pump driver 105 drives the circulation pump 55. The open/close valve driver 106 drives the open/close valve 56. The sensor input/output port 107 is connected with various sensors such as, e.g., liquid surface sensor.

Figure 5:
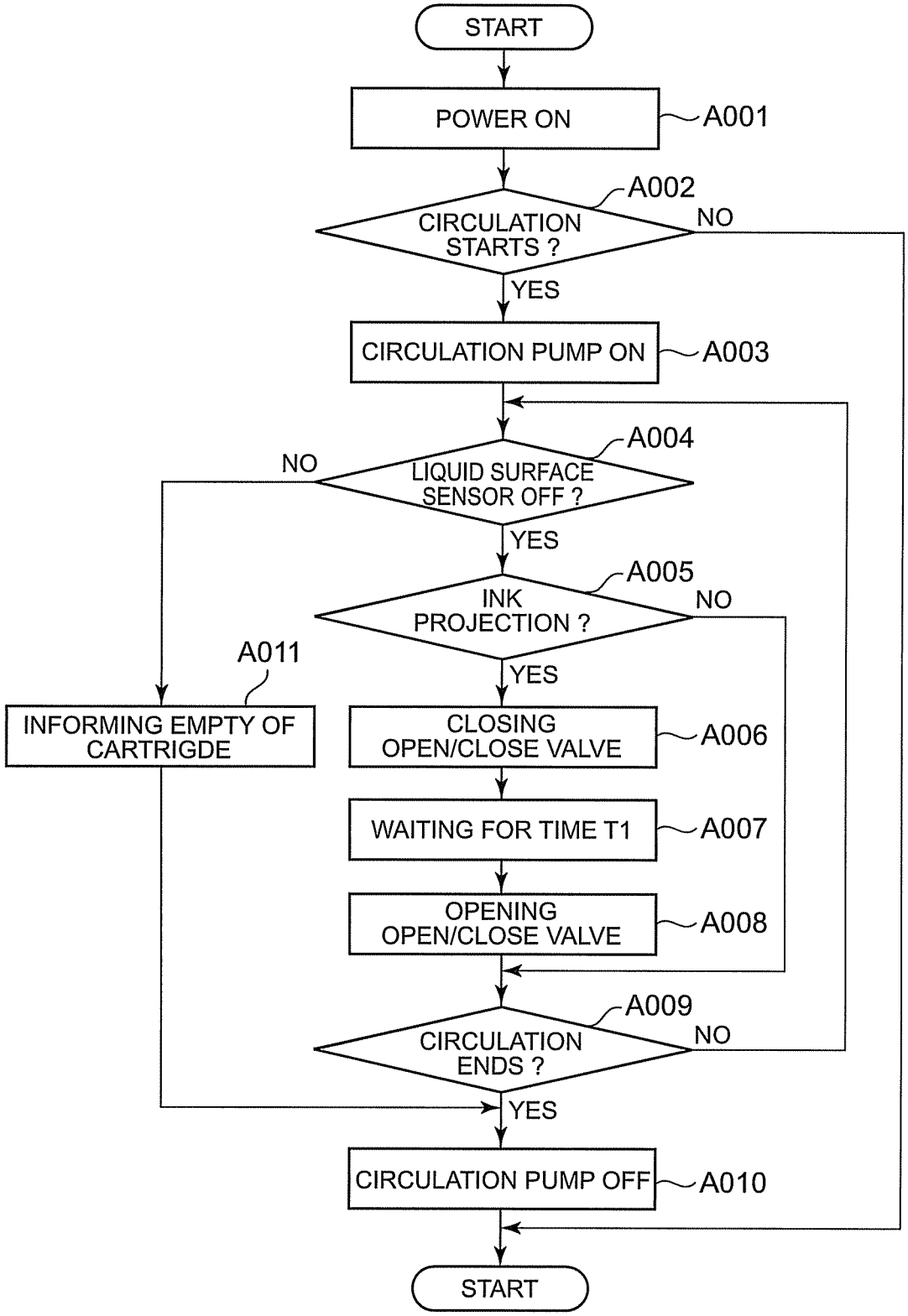
FIG. 5 is a flow chart showing an ink supply process of the ink supply apparatus.

FIG. 5 is a flow chart showing an example of the ink supply process by the controller 58 of the ink supply apparatus 20 according to the present embodiment. In Act A001 in FIG. 5, an electric power source of the ink supply apparatus is on. In Act A002, it is determined whether or not the ink circulation begins. If the circulation begins, the circulation pump 55 is driven (Act A003). In Act A004, it is judged whether or not the liquid surface sensor 57 is off. If the liquid surface sensor 57 is on (there is no ink), it is informed that the ink cartridge 21 is empty (Act A011). And then, the circulation pump 55 is stopped (Act A010) and the ink circulation is terminated. In Act A004, if the liquid surface sensor 57 is off (there is some amount of ink), it is judged whether or not the ink projection performs to execute wiping (Act A005).

If the ink projection performs, the open/close valve 56 is closed (Act A006) and ink is projected from the orifice plate 41. In Act A007, a given time T1 is waited and the open/close valve 56 is being opened in Act A008. In Act A009, it is judged whether or not the ink circulation is finished. If the ink circulation is not finished, the ink circulation is continued (Act A004). In Act A009, if the ink circulation is finished, the circulation pump 55 is stopped to finish the operation (Act A010).

The ink supply apparatus 20 according to the present embodiment can be applied to an image forming apparatus other than the ink jet printer, and a use other than the image forming apparatus.

The present invention has been described with respect to specific embodiments. However, these embodiments have been presented by way of example only. Other embodiments based on the principles of the present invention should be obvious to those of ordinary skill in the art. Such embodiments are intended to be covered by the claims.

What is claimed is:

1. An ink supply apparatus, which supplies ink to a recording head having a nozzle, an ink supply opening and ink recovery opening, comprising:

a pump including an intake port and a discharge port;

a first tank including a first inflow port connected to the discharge port of the pump and a first outflow port connected to the ink supply opening of the recording head;

a second tank including a second inflow port connected to the ink recovery opening of the recording head and a second outflow port connected to the intake port of the pump;

a third tank, including an ink storage part open to air, which is supplied with ink from an ink supply source;

a first relay pipe connected between the first tank and the third tank;

a first pressure adjusting mechanism, arranged at the first relay pipe, which is configured to open if the pressure in the first tank is greater than a first given value to discharge ink in the first tank to the third tank;

a second relay pipe which connects the ink storage part of the third tank and the second tank; and a second pressure adjusting mechanism, arranged at the second relay pipe, which is configured to open if the pressure in the third tank is lower than a second given value smaller than the first given value to draw ink in the third tank into the second tank.

2. The apparatus according to claim 1, wherein the first pressure adjusting mechanism is a first relief valve which opens if the pressure in the first tank is greater than the first given value.

3. The apparatus according to claim 1, wherein the second pressure adjusting mechanism is a second relief valve which opens if the pressure in the second tank is lower than the second given value.

4. The apparatus according to claim 1 further comprising a first pressure follow member, arranged at the first tank, which is configured to deform according to the pressure change in the first tank.

5. The apparatus according to claim 4, wherein the first pressure follow member is comprised with a first elastic member which is elastically deformed according to the pressure change in the first tank.

6. The apparatus according to claim 1 further comprising a second pressure follow member, arranged at the second tank, which is configured to deform according to the pressure change in the second tank.

7. The apparatus according to claim 6, wherein the second pressure follow member is comprised with a second elastic member which is elastically deformed according to the pressure change in the second tank.

8. The apparatus according to claim 1 further comprising a return pipe, having an open/close valve, which connects the second inflow port of the second tank and the ink recovery opening of the recording head.

9. The apparatus according to claim 8 further comprising a controller for controlling the open/close valve, the controller closing the open/close valve in a mode in which ink is projected from the nozzle of the recording head.

10. The apparatus according to claim 1, wherein the third tank includes a connecting port, connected to the first relay pipe, the lower end of which is open above the liquid surface of ink in the third tank.

11. The apparatus according to claim 1, wherein the first and second pressure adjusting mechanisms are controlled so that the pressure (Pn) near the nozzle of the recording head is a negative value including zero (0) and satisfy the following formula:

$$P2=\{(R1+R2)/R1\}\times Pn-(R2/R1)\times P1$$

Wherein:

P1 (Pa): the energy per unit volume near the first outflow port of the first tank, R1 (Pa·sec/$m^3$): the flow pass resistance of the supply pipe from the first outflow port to the nozzle of the recording head, P2 (Pa): the energy per unit volume near the second inflow port of the second tank, and R2 (Pa·sec/$m^3$): the flow pass resistance of the return pipe from the second inflow port to the nozzle of the recording head.

* * * * *